US010520245B2

(12) United States Patent
Akca et al.

(10) Patent No.: US 10,520,245 B2
(45) Date of Patent: Dec. 31, 2019

(54) HOME APPLIANCE DEVICE AND ASSEMBLY METHOD

(71) Applicant: BSH HAUSGERAETE GMBH, Munich (DE)

(72) Inventors: Serdar Akca, Tekirdag (TR); Ziya Arslankiray, Tekirdag (TR); Emre Emek, Istanbul (TR); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 50 days.

(21) Appl. No.: 15/582,932

(22) Filed: May 1, 2017

(65) Prior Publication Data

US 2018/0313602 A1 Nov. 1, 2018

(51) Int. Cl.

| | |
|---|---|
| ***F25D 25/02*** | (2006.01) |
| ***A47B 57/06*** | (2006.01) |
| ***F25D 23/06*** | (2006.01) |
| ***F25D 11/00*** | (2006.01) |

(52) U.S. Cl.

CPC ..... *F25D 25/02* (2013.01); *A47B 57/06* (2013.01); *F25D 11/00* (2013.01); *F25D 23/067* (2013.01); *F25D 2325/021* (2013.01)

(58) Field of Classification Search

CPC ..... F25D 25/02; F25D 11/00; F25D 23/067; F25D 2325/021; A47B 57/06

USPC ..... 312/408; 108/108

See application file for complete search history.

(56) References Cited

U.S. PATENT DOCUMENTS

| | | | | | |
|---|---|---|---|---|---|
| 3,143,981 | A * | 8/1964 | Tassell | A47B 57/54 | 108/108 |
| 3,351,313 | A * | 11/1967 | Guillon | A47B 57/565 | 108/106 |
| 3,765,344 | A * | 10/1973 | Ferdinand | A47B 45/00 | 108/108 |
| 3,779,499 | A * | 12/1973 | Shell | A47B 57/46 | 248/220.43 |
| 3,848,844 | A * | 11/1974 | Barrett | A47B 57/56 | 108/106 |
| 4,244,637 | A * | 1/1981 | Boorman, Jr. | F25D 25/02 | 248/243 |
| 5,004,302 | A * | 4/1991 | Stocking | A47B 57/42 | 108/107 |
| 5,486,045 | A * | 1/1996 | Dasher | A47B 57/06 | 248/300 |
| 6,644,609 | B1 * | 11/2003 | Scott | A47B 57/42 | 248/243 |
| 7,669,945 | B2 * | 3/2010 | Blersch | F25D 23/067 | 108/107 |
| 7,798,339 | B2 * | 9/2010 | Brooks | G11B 33/02 | 211/103 |
| 8,123,315 | B2 * | 2/2012 | Hagele | A47B 57/425 | 312/408 |

(Continued)

*Primary Examiner* — Daniel J Troy
*Assistant Examiner* — Timothy M Ayres
(74) *Attorney, Agent, or Firm* — Laurence A. Greenberg; Werner H. Stemer; Ralph E. Locher

(57) ABSTRACT

A home appliance device with improved characteristics regarding a user's convenience, in particular a chiller home appliance device, includes at least one holding unit configured to at least partly hold at least one first shelf and at least one second shelf. The holding unit is configured to hold the first shelf next to the second shelf with respect to at least one width direction.

16 Claims, 11 Drawing Sheets

(56) References Cited

U.S. PATENT DOCUMENTS

| | | | | |
|---|---|---|---|---|
| 8,240,791 | B2 * | 8/2012 | Benz | A47B 96/027 211/153 |
| 8,820,865 | B2 * | 9/2014 | Simpson | F25D 23/067 108/108 |
| 8,926,034 | B2 * | 1/2015 | Park | A47B 96/025 108/102 |
| 9,212,848 | B2 * | 12/2015 | Kendall | F25D 27/00 |
| 9,261,305 | B2 * | 2/2016 | Tunzi | F25D 25/02 |
| 9,366,470 | B2 * | 6/2016 | Hasturk | F25D 11/00 |
| 10,126,042 | B2 * | 11/2018 | Cetinyol | F25D 23/066 |
| 2013/0160483 | A1 | 6/2013 | Hastuerk et al. | |
| 2014/0375199 | A1 * | 12/2014 | Lee | F25D 25/024 312/404 |
| 2016/0033195 | A1 * | 2/2016 | Kerner | F25D 25/024 312/408 |
| 2016/0290711 | A1 * | 10/2016 | Brown | F25D 25/02 |
| 2018/0149411 | A1 * | 5/2018 | Emek | F25D 23/066 |

* cited by examiner

HOME APPLIANCE DEVICE AND ASSEMBLY METHOD

BACKGROUND OF THE INVENTION

Field of the Invention

The invention relates to a home appliance device, in particular a chiller home appliance device, home appliance device, comprising: at least one holding unit configured to at least partly hold at least one first shelf and at least one second shelf, and to a method for assembling such a home appliance device.

Published patent application US 2013/0160483 A1, describes a home appliance device with a holding unit which has a holding element. The holding element partly holds a first shelf and a second shelf. In an installation position, the holding element holds the first shelf and the second shelf with respect to a vertical direction one above the other.

SUMMARY OF THE INVENTION

An objective of the invention is, in particular, to provide a home appliance device with improved characteristics regarding a user's convenience. The objective is achieved by way of the claimed invention. Further implementations and further developments of the invention may be gathered from the dependent claims.

A home appliance device, in particular a chiller home appliance device, is proposed, comprising: at least one holding unit configured to at least partly hold at least one first shelf and at least one second shelf, the holding unit being configured to hold the first shelf beside the second shelf with respect to at least one width direction, in particular in an installation position.

By a "home appliance device" is in particular to be understood at least a portion, preferably a sub-assembly group, of a home appliance. The home appliance is in particular provided for storing and preferably tempering victuals such as beverages, meat, fish, vegetables, fruits, milk and/or dairy products in at least one operating state, advantageously for the purpose of enhancing a keepability of the stored victuals. For example, the home appliance is embodied as a chiller home appliance, which is in at least one operating state configured for cooling victuals. The chiller home appliance could in particular be embodied as a climate cabinet and/or as an ice-box and/or as a refrigerator and/or as a freezer and/or as a refrigerator-freezer combination and/or as a wine cooler. However, the home appliance could also be embodied as a home appliance for warming up and in particular for cooking victuals, e.g. an oven and/or a steamer and/or a microwave. Alternatively the home appliance could also be embodied as a home appliance for cleaning, e.g. a dishwasher. The home appliance may in particular comprise more than one home appliance device.

A "holding unit" is to be understood as a unit which in at least one assembled state at least partly absorbs and/or receives a weight of the first shelf and a weight of the second shelf and which in particular transfers the absorbed and/or received weight to at least one further unit. The further unit can in particular be an inner liner and/or an inner liner wall section of the home appliance device. In at least one assembled state, the holding unit in particular at least partly absorbs and/or receives, in particular in addition to the weight of the first shelf and to the weight of the second shelf, a weight of stored victuals placed on at least one of the shelves. By the wording that the holding unit "at least partly" absorbs and/or receives a weight of at least one object is in particular to be understood that the holding unit absorbs and/or receives a portion of minimally 20%, or of minimally 25%, or of minimally 30%, or of minimally 35% or of minimally 40% of the weight of the object.

By the wording that the holding unit is configured to at least "partly" hold at least one first shelf and at least one second shelf is in particular to be understood that the holding unit holds at least one portion of the first shelf and at least one portion of the second shelf. In particular, the portion of the first shelf can be an end region of the first shelf. In particular, the portion of the second shelf can be an end region of the second shelf. A shelf is in particular configured for placing victuals on. In particular the shelf has an at least essentially plate-like shape.

Regarding a projection of the shelves onto a plane which is parallel to a main extension plane of at least one of the shelves, the first shelf and the second shelf are arranged next to each other with respect to the width direction. This means that, regarding the projection of the shelves onto the plane and starting, for example, at a point on the first shelf and proceeding in the width direction, one first passes a border of the first shelf and afterwards one passes a border of the second shelf. By a "main extension plane" of an object in particular a plane is to be understood which is oriented parallel to a largest side of a smallest imaginary rectangular cuboid just still entirely enclosing the object, and which in particular extends through a center point of the rectangular cuboid.

A width direction is in particular defined regarding an installation position of the home appliance device and/or of the home appliance, and/or is oriented parallel to a base. The base in particular defines an at least substantially horizontal plane. In an installation position, the width direction is oriented in particular perpendicularly to a viewing direction of a user who is, in particular, standing in front of an appliance body. In an installation position, the width direction in particular oriented from a first side wall of the appliance body to a second side wall of the appliance body. In an installation position, the width direction is oriented in particular perpendicularly to a direction extending from an appliance door to a rear wall of the appliance body.

In this context, "configured" is in particular to mean specifically designed and/or equipped. By an object being configured for a certain function is in particular to be understood that the object implements and/or fulfills said certain function in at least one application state and/or operating state.

By means of the invention in particular a high level of convenience for a user of the home appliance device can be achieved. In particular in the case of a chiller home appliance with two doors one beside the other with respect to the width direction, only one door needs to be opened to adjust a height level of at least one of the shelves. In addition, a high degree of flexibility can be provided. It is in particular possible to adjust the height level of the first shelf and the second shelf independently from each other. In particular in comparison with at least one rail unit of the home appliance device, a simple construction can in particular be provided, and thereby a low weight of the holding unit, in particular in comparison with the rail unit, can in particular be provided.

Further, it is proposed that the holding unit may be configured to hold the first shelf and the second shelf, in at least one mounted position of the shelves, with at least substantially the same height level in particular in an installation position. The holding unit may be configured to hold the first shelf and the second shelf in at least one further mounted position on at different height levels in particular regarding an installation position. In at least one further mounted position the first shelf and the second shelf are distanced from each other with respect to at least one vertical direction in particular regarding an installation position. The vertical direction is in particular oriented perpendicularly to a base. In an installation position, the vertical direction and the width direction are in particular oriented perpendicularly to each other. The first shelf and the second shelf may in the mounted position be arranged at the same height level and in particular be flush with respect to each other, wherein in particular small tolerances are acceptable. In the mounted position the first shelf in particular has a first distance from the base. In the mounted position the second shelf in particular has a second distance from the base. In particular, a ratio of the shorter one of the distances to the larger one of the distances may be minimally 0.8, or be minimally 0.85, or be minimally 0.9, or be minimally 0.95 or be 0.98. A "height level" of an object is to mean in particular a distance of the object from the base in an installation position. As a result of this, in particular a high level of convenience for a user and/or a very large storage area can be provided.

Furthermore, it is proposed that the holding unit may comprise at least one base body, which is connectable to at least one inner liner wall section. The home appliance device in particular may comprise at least one appliance body, which in particular defines at least one storage space at least partially. An "appliance body" is in particular to be understood as a unit which at least partly defines at least one storage space and in particular defines the storage space at least substantially together with at least one appliance door, in at least one operating state. In particular, the home appliance device may comprise the appliance door. In at least one operating state, the appliance body and the appliance door in particular may define the storage space at least substantially and in particular, considering tolerances, completely. The appliance body may in particular comprise at least one inner liner and in particular at least one outer liner. The inner liner and the outer liner may in particular be connected to each other and in particular define and/or enclose together an interior space, which may in particular be at least mostly filled with at least one isolation material. The inner liner may in particular comprise at least two, in particular at least four and in particular at least five walls. The walls in particular delimit the storage space. The walls may in particular be respectively embodied as a lateral wall and/or as a rear wall and/or as a bottom wall and/or as a top wall. The inner liner may in particular have two lateral walls, for example opposite each other, one rear wall, one bottom wall and one top wall which may for example be located opposite the bottom wall. In particular, the inner liner wall section may be part of the inner liner and preferably of the rear wall of the inner liner. The base body may particular at least mostly define the form and/or shape of the holding unit. In particular, the base body may have a mass fraction and/or volume fraction of minimally 50%, in particular of minimally 60%, advantageously of minimally 65%, preferably of minimally 70% and especially preferentially of minimally 75% of the holding unit. The term "at least mostly" with reference to an object is in particular to mean by more than 50%, preferably by more than 65%, further preferably by more than 80% and advantageously by more than 95% of the object, in particular of a surface area, preferably of a volume and/or of a mass of the object. The base body may have an at least substantially constant shape with respect to a longitudinal extension direction of the base body. When mounted, the base body may in particular define at least one portion of a wall which delimits the storage space at least partly. The base body may in particular prevent a leakage during a foaming process. On account of this, in particular a high degree of stability can be provided.

In addition, it is proposed that the holding unit may comprise at least one holding element defining at least one height level of at least one of the shelves. The holding element may in particular be embodied at least mostly of plastic. The holding element may also be embodied at least mostly of metal. The holding element may particular comprise at least one opening in which in particular at least one portion of one of the shelves and/or at least one portion of at least one shelf supporting element may be insertable. The home appliance device may in particular comprise at least one shelf supporting element, which is in particular configured to be inserted in the opening of the holding element and in particular has at least one supporting surface on which the shelf is in particular located in at least one mounted position. In particular, the holding element may be embodied as an elongate part. The holding element may in particular comprise at least two, or at least four, or at least six or at least eight openings, which may in particular be spaced apart from each other in a longitudinal extension direction of the holding element and define different height levels of the first shelf. As a result of this, in particular a high level of convenience for a user can be provided.

The holding unit may for example comprise exactly one holding element. It is proposed that the holding unit may comprise at least one further holding element defining at least one position of the further one of the shelves. The further holding element may in particular be embodied at least mostly from plastic. The further holding element may also be embodied at least mostly from metal. The further holding element may in particular comprise at least one further opening, in which in particular at least one portion of one of the shelves and/or at least one portion of at least one shelf supporting element may be insertable. In particular, the further holding element may be embodied as an elongate part. The further holding element may in particular comprise at least two, or at least four, or at least six or at least eight further openings, which may in particular be spaced apart from each other in a longitudinal extension direction of the further holding element and define different height levels of the second shelf. On account of this, in particular a high degree of flexibility can be provided.

Further, it is proposed that the holding element and the further holding element may be arranged in particular at least substantially parallel to each other. A main extension of the holding element and a main extension of the further holding element are in particular arranged at least substantially parallel to each other. "At least substantially parallel" is herein in particular to mean an orientation of a direction with respect to a reference direction, in particular in a plane, wherein the direction differs from the reference direction in particular by less than 8°, advantageously by less than 5° and especially advantageously by less than 2°. A "main extension direction" of an object is in particular to mean an extension of the object in a longitudinal extension direction of the object. A "longitudinal extension direction" of an object is in particular to mean a direction which is oriented parallel to a largest side of a smallest imaginary rectangular cuboid which just still entirely encloses the object. An "extension" of an object is in particular to mean a maximum distance between two points of a perpendicular projection of the object onto a plane. As a result of this, in particular a very high level of convenience for a user can be provided.

In particular, the holding element and the further holding element may differ from each other in at least one characteristic, for example regarding a material and/or an extension and/or a weight and/or a shape and/or a number of openings. The holding element and the further holding element may also be embodied identically to each other. On account of this, in particular a low level of storage effort and/or a cost-saving implementation may be provided. In particular, a very quick and/or easy manufacturing process can be established.

Furthermore, it is proposed that the holding element may be inserted in the base body. In particular, the base body may comprise at least one guiding groove, which the holding element may in particular be inserted into. The further holding element may be inserted in the base body. In particular the base body may comprise at least one further guiding groove, which the further holding element is in particular inserted into. In particular, the holding element may at least essentially be L-shaped. The holding element may comprise at least one stopping part, which in particular stops an insertion movement of the holding element into the base body. In particular, the further holding element may at least essentially be L-shaped. The further holding element may comprise at least one further stopping part, which in particular stops an insertion movement of the further holding element into the base body. A force acting on the first shelf may in particular be transferred to the holding element and from the holding element in particular to the base body and from the base body in particular to the inner liner wall section. A force acting on the second shelf is in particular transferred to the further holding element and from the further holding element in particular to the base body and from the base body in particular to the inner liner wall section. On account of this, in particular a high stability can be provided.

In particular, the holding element may be arranged in such a way that it is movable with respect to the base body. In addition, the further holding element may be arranged in such a way that it is movable with respect to the base body. The holding unit may comprise at least one alignment element, which fixes the holding element in a position relative to the base body. In at least one mounted position the alignment element may in particular prevent the holding element from moving with respect to the base body. In at least one assembled state, the alignment element may in particular at least partly project through the opening of the holding element. The base body may in particular comprise at least one alignment aperture through which the alignment element in particular at least partly projects in at least one assembled state. The holding unit may comprise at least one further alignment element, which fixes the further holding element in a position relative to the base body. In at least one mounted position the further alignment element may in particular prevent the further holding element from moving with respect to the base body. In at least one assembled state, the further alignment element may in particular at least partly project through the further opening of the further holding element. The base body may in particular comprise at least one further alignment aperture through which the further alignment element may in particular at least partly project in at least one assembled state. In particular, the alignment element and the further alignment element may align the first shelf and the second shelf when the first shelf and the second shelf are placed at the same height level. As a result of this, in particular a highly stable configuration can be provided.

In addition, it is proposed that the holding unit may comprise at least one end cap, which is mounted to the base body. In particular the holding unit may comprise at least two end caps, which are mounted to the base body and are in particular embodied as a first end cap and as a second end cap. In at least one mounted position, the first end cap and the second end cap may in particular be mounted to different ends of the base body. In particular, the first end cap and the second end cap may be distanced from each other with respect to a longitudinal extension direction of the base body in at least one mounted position. In at least one assembled state, at least one longitudinal extension direction of the base body may in particular be at least substantially parallel to the vertical direction. The end cap, in particular the first end cap and/or the second end cap, may in particular prevent a leakage during a foaming process. On account of this, in particular a high degree of stability can be provided.

Further, it is proposed that the home appliance device may further comprise at least one inner liner having at least one aperture which the holding unit, in particular the end cap of the holding unit, at least partially passes through. By the wording that the holding unit "at least partially" passes through the aperture of the inner liner is in particular to be understood that at least a portion of the holding unit passes through the aperture of the inner liner. The holding unit, in particular the end cap of the holding unit, may be arranged on two opposite sides of the inner liner in at least one mounted state. An "aperture" is to be understood as a hole and/or opening. As a result of this, the holding unit can in particular be fixed to the inner liner in an easy and/or cost-saving manner.

For example, the inner liner may comprise at least one retainer for at least partly receiving the holding unit. Preferably, the holding unit comprises at least one retainer for at least partly receiving the inner liner. By the wording that a retainer of a first object "at least partly" receives a second object is in particular to be understood that the retainer of the first object receives at least a portion of the second object preferably in a form-fit fashion. On account of this, in particular a cost-saving implementation can be provided. In particular, an extra element for fixing the holding unit to the base body can be dispensed with. In particular, easy mountability can be provided.

In addition, it is proposed that the holding unit may be arranged at least largely behind the inner liner and in particular inside the storage space. As a result of this, in particular a compact embodiment can be provided.

A convenience for a user can be further improved by a method for assembling a home appliance device, the home appliance device comprising at least one inner liner, which at least one inner liner wall section, and at least one holding unit which is configured to at least partly hold at least one first shelf and at least one second shelf, the holding unit being configured to hold the first shelf next to the second shelf with respect to at least one direction, the method comprising aq step of connecting the holding unit to the inner liner wall section. In particular, in one step the holding element is inserted into the base body, in particular into the guiding groove of the base body, in particular until the stopping part of the holding element stops the movement of the holding element in an insertion direction. In particular, in one step the further holding element is inserted into the base body, in particular into the further guiding groove of the base body, in particular until the further stopping part of the further holding element stops the movement of the further holding element in the insertion direction. In one step, the first end cap is connected to the base body, in particular on the side on which the stopping part and/or the further stopping part are/is located. The first end cap, the base body and the holding elements constitute a subassembly group. In one step, the subassembly group is connected to the inner liner, in particular to the inner liner wall section. The first end cap passes through the aperture of the inner liner. The holding unit comprises at least one fixing element, by means of which the subassembly group is fixed to the inner liner, in particular to the inner liner wall section. The fixing element may in particular be a screw. In one step, the second end cap is connected to the subassembly group in particular by clipping the second end cap to the inner liner, in particular to the inner liner wall section. The alignment element is in particular fixed to the base body, in particular in order to keep the holding element in the correct position. In one step, the further alignment element is in particular fixed to the base body, in particular in order to keep the further holding element in the correct position.

Herein the home appliance device is not to be limited to the application and implementation described above. In particular, for the purpose of fulfilling a functionality herein described, the home appliance device may comprise a number of respective elements, structural components and units that differs from the number mentioned herein. Furthermore, regarding the value ranges mentioned in this disclosure, values within the limits mentioned are to be understood to be also disclosed and to be used as applicable.

Further advantages may become apparent from the following description of the drawing. In the drawing an exemplary embodiment of the invention is shown. The drawing, the description and the claims contain a plurality of features in combination. Someone having ordinary skill in the art will purposefully also consider the features separately and will find further expedient combinations.

If there is more than one specimen of a certain object, only one of these is given a reference numeral in the figures and in the description. The description of this specimen may be correspondingly transferred to the other specimens of the object.

DETAILED DESCRIPTION OF THE INVENTION

Figure 1:
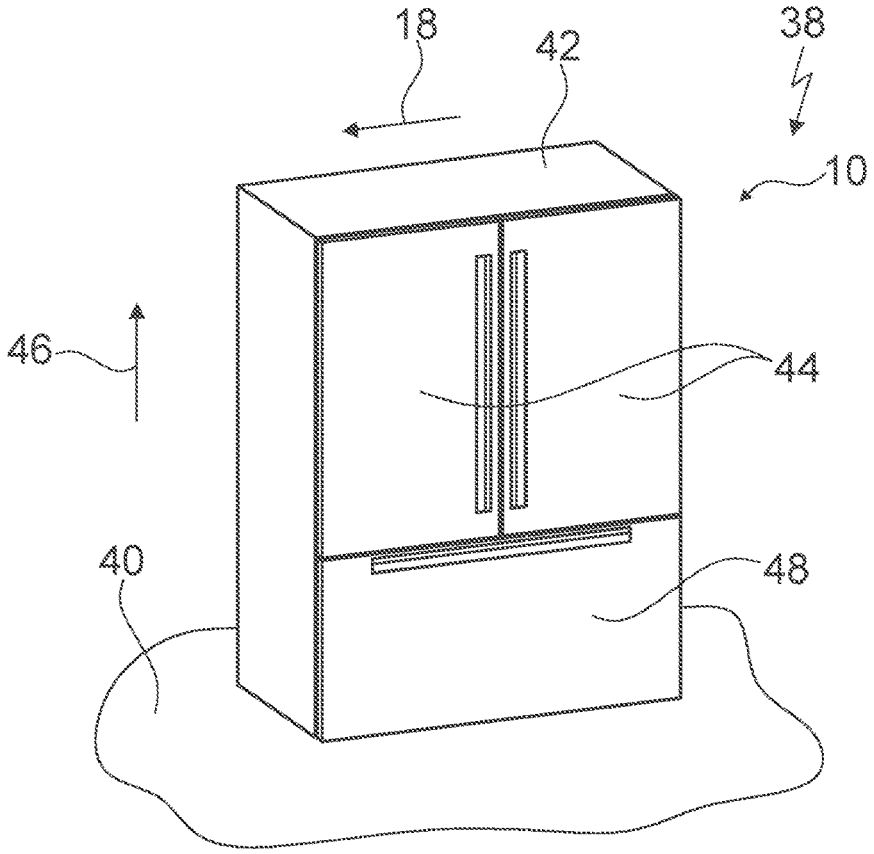
FIG. 1 a home appliance comprising a home appliance device in a schematic front view, FIG. 2 an inner liner wall section of an inner liner, a first shelf, a second shelf, a third shelf, two rail units and a holding unit of the home appliance device in a mounted position in a schematic view, FIG. 3 the home appliance device in an assembled state in a schematic view, FIG. 4 the home appliance device in a schematic exploded view, FIG. 5 a base body of the home appliance device in a schematic perspective view, FIG. 6 a holding element and a further holding element of the holding unit in a schematic perspective view, FIG. 7 the holding element, the further holding element and the base body in an assembled state in a schematic perspective view, FIG. 8 an alignment element and a further alignment element of the holding unit in a schematic perspective view, FIG. 9 the alignment element, the further alignment element, the holding element, the further holding element and the base body in an assembled state in a schematic perspective view, FIG. 10 a first end cap and a second end cap of the holding unit in a schematic perspective view, FIG. 11 the first end cap, the second end cap and the base body in an assembled state in a schematic perspective view, FIG. 12 the inner liner and the holding unit in an assembled state in a schematic view from a rear side, FIG. 13 the inner liner and the holding unit in an assembled state in a schematic sectional view, FIG. 14 section XIV of FIG. 13 in a schematic sectional view, FIG. 15 section XV of FIG. 13 in a schematic sectional view, FIG. 16 the holding unit in an assembly step in a schematic perspective view, FIG. 17 the holding unit in a further assembly step in a schematic perspective view, FIG. 18 the holding unit in a further assembly step in a schematic perspective view, FIG. 19 the holding unit in a further assembly step in a schematic perspective view, FIG. 20 a subassembly group of the holding unit and the inner liner in a further assembly step in a schematic view from a rear side, FIG. 21 a subassembly group and the inner liner in a further assembly step in a schematic view from a front side, FIG. 22 a subassembly group and the inner liner in a further assembly step in a schematic view from a rear side, FIG. 23 a subassembly group and the inner liner in a further assembly step in a schematic view from a rear side, FIG. 24 a subassembly group and the inner liner in a further assembly step in a schematic side view, and FIG. 25 the holding unit, the inner liner and two rail units of the home appliance device in a schematic side view from a rear side.

FIG. 1 shows a home appliance 38 comprising a home appliance device 10, in a schematic perspective view. The home appliance 38 is embodied as a chiller home appliance. The home appliance device 10 is embodied as a chiller home appliance device.

In the present embodiment the home appliance 38 is embodied as a refrigerator. The home appliance 38 could further be embodied in particular as a wine cooler and/or a climate cabinet and/or an ice-box and/or a freezer and/or a refrigerator-freezer combination.

In FIG. 1 the home appliance device 10 is shown in an installation position. The home appliance device 10 is installed on a base 40. The base 40 defines a substantially horizontal plane.

The home appliance device 10 comprises an appliance body 42. The appliance body 42 partly defines an appliance housing. The appliance body 42 is installed on the base 40 in a substantially upright fashion.

The appliance body 42 partly defines a storage space (not shown). The storage space is embodied as a refrigeration space.

The home appliance device 10 comprises at least one appliance door 44. In the present case the home appliance device 10 comprises two appliance doors 44. The appliance doors 44 are located next to each other with respect to a width direction 18. For the sake of clarity, in the following only one appliance door 44 is described in detail. The following description may be transferred to the other appliance door 44 accordingly.

The appliance door 44 is connected to the appliance body 42. In an assembled state, the appliance door 44 is rotatably connected to the appliance body 42.

The appliance body 42 partly defines a further storage space (not shown). The further storage space is embodied as a freezer space. In an installation position, the further storage space is located below the storage space with respect to a vertical direction 46.

The home appliance device 10 comprises at least one further appliance door 48. In the present case the home appliance device 10 comprises a further appliance door 48. In an installation position, the further appliance door 48 is located below the appliance door 44 with respect to the vertical direction 46. The further appliance door 48 is connected to the appliance body 42. In an assembled state, the further appliance door 48 is movably connected to the appliance body 42.

Figure 5:
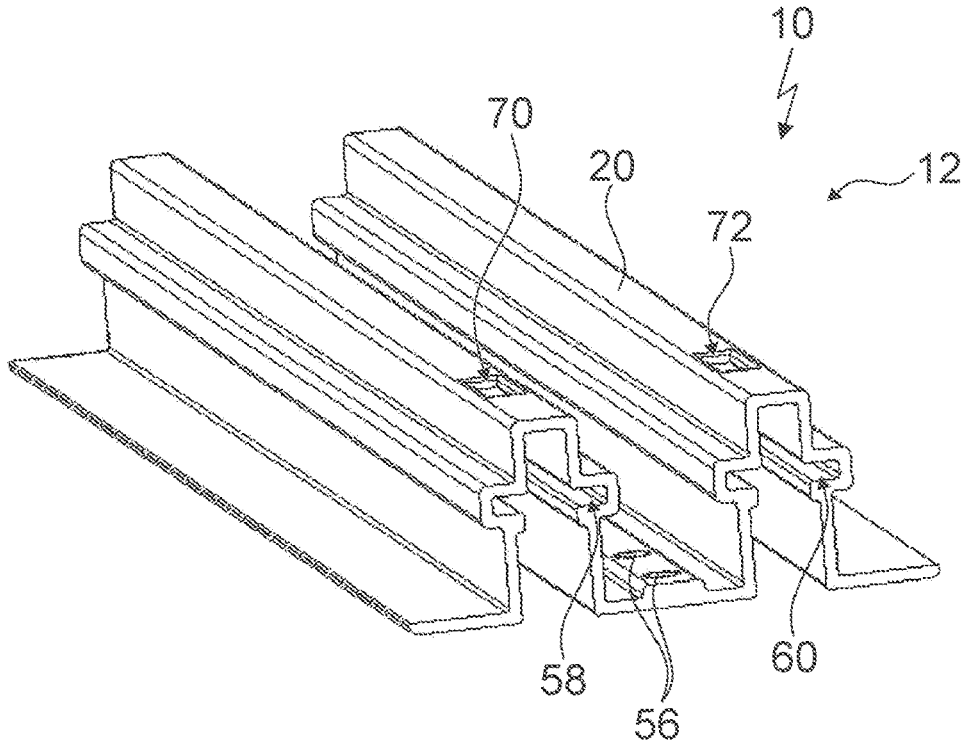

The home appliance device 10 comprises an inner liner 34 (compare FIG. 5). The inner liner 34 is part of the appliance body 42. The inner liner 34 comprises an inner liner wall section 22. The inner liner wall section 22 is a portion of a rear wall of the inner liner 34.

The home appliance device 10 comprises a first shelf 14. The home appliance device 10 comprises a second shelf 16. The home appliance device 10 comprises a third shelf 50. In an alternative embodiment the home appliance device 10 may comprise another number of shelves, in particular a larger number. For example, the home appliance device 10 may comprise at least four, advantageously at least six, preferably at least eight and preferentially at least ten shelves.

An extension of the third shelf 50 in its longitudinal extension direction is greater than an extension of the first shelf 14 in its longitudinal extension direction. An extension of the third shelf 50 in its longitudinal extension direction is greater than an extension of the second shelf 16 in its longitudinal extension direction.

The home appliance device 10 comprises at least one rail unit 52. In the present embodiment the home appliance device 10 comprises two rail units 52. The rail units 52 hold the third shelf 50 in a mounted position. In an assembled state, the rail units 52 are connected to the inner liner 34. The rail units 52 are distanced from each other with respect to the width direction 18. A distance between the two rail units 52 is substantially identical to an extension of the third shelf 50 in a longitudinal extension direction of the third shelf 50.

Figure 2:
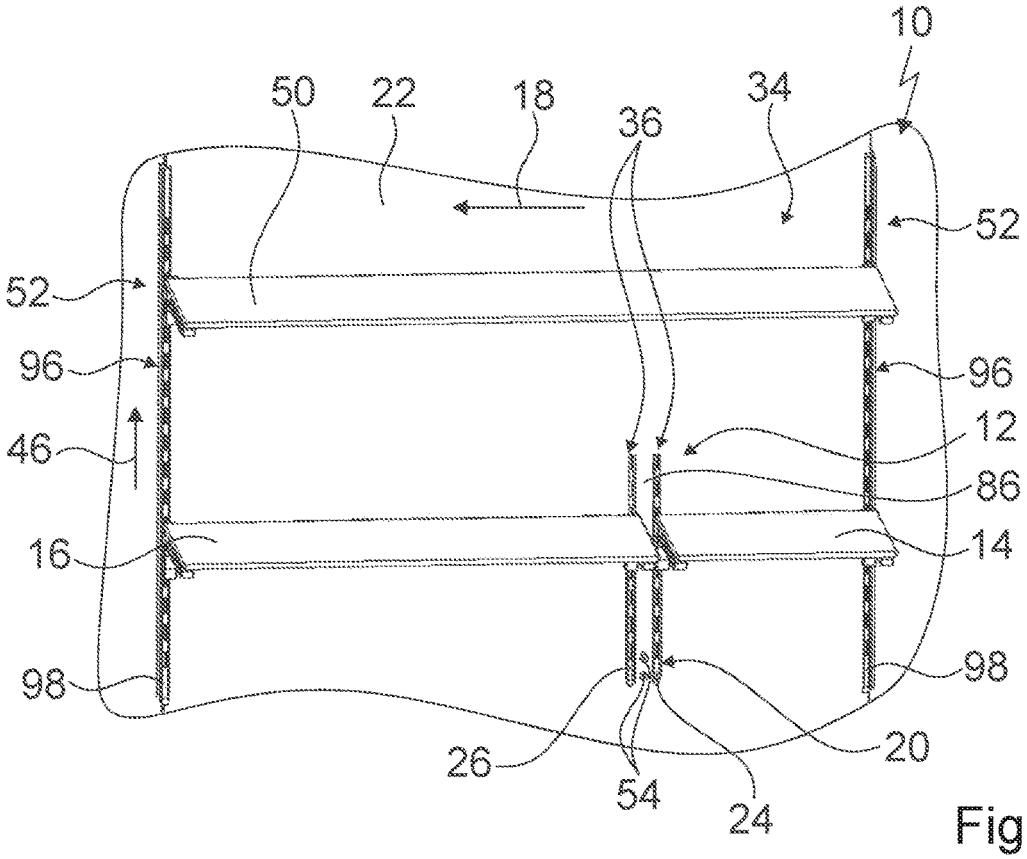
Figure 3:
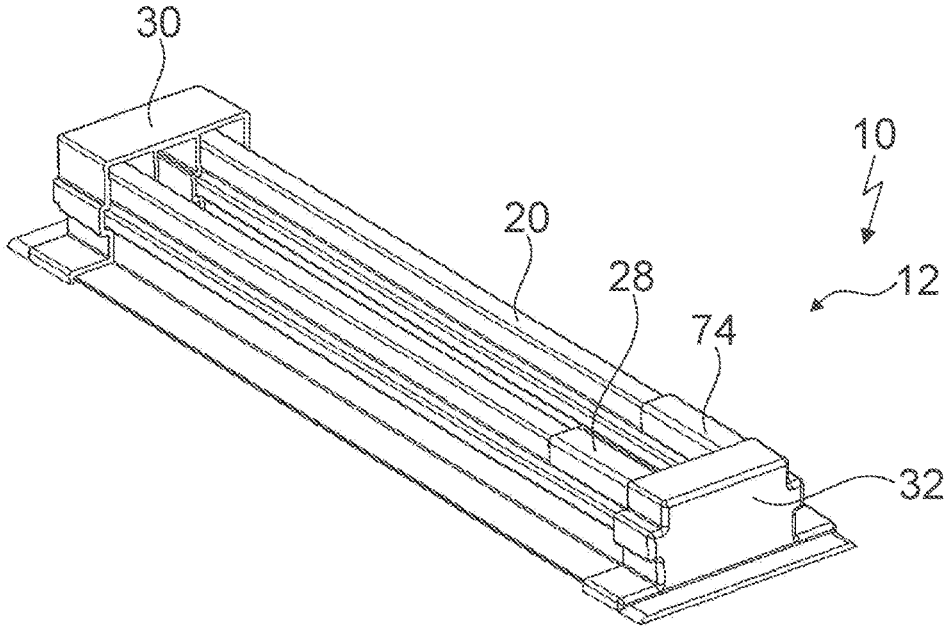
Figure 4:
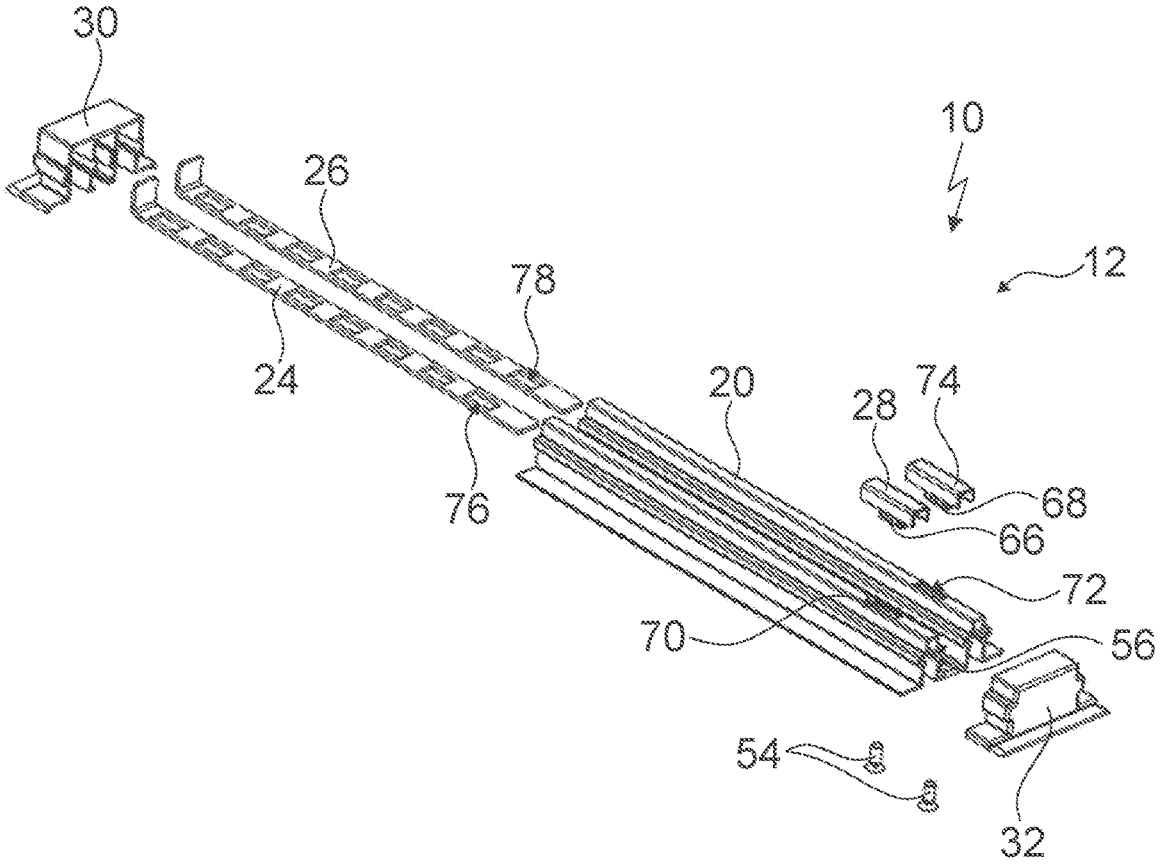

The home appliance device 10 comprises a holding unit 12 (compare FIGS. 2 to 4). The holding unit 12 holds the first shelf 14 and the second shelf 16 in a mounted position. With respect to the width direction 18, the holding unit 12 is located between the rail units 52.

In a mounted position, the holding unit 12 holds the first shelf 14 next to the second shelf 16 with respect to the width direction 18. The holding unit 12 holds the first shelf 14 and the second shelf 16 in a mounted position at substantially the same height level.

The holding unit 12 comprises a base body 20. The base body 20 is connected to the inner liner 34 in an assembled state. In the present embodiment, the base body 20 is connected to the inner liner wall section 22 of the inner liner 34 in an assembled state.

The holding unit 12 comprises at least one fixing element 54 (compare FIGS. 2 and 4). In the present embodiment, the holding unit 12 comprises two fixing elements 54. For the sake of clarity, in the following only one fixing element 54 is described in detail. The following description may be transferred to the other fixing element 54 accordingly.

In the present embodiment, the fixing element 54 is embodied as a screw. The base body 20 is fixed to the inner liner 34 by means of the fixing element 54. The base body 20 comprises at least one fixing aperture 56 (compare FIG. 5). In an installation position, the fixing element 54 is hidden behind another component and therefore in particular invisible for a user.

In the present embodiment, the holding unit 12 comprises two fixing apertures 56. For the sake of clarity, in the following only one fixing aperture 56 is described in detail. The following description may be transferred to the other fixing aperture 56 accordingly.

The fixing aperture 56 is configured for receiving the fixing element 54 partly. In an assembled state, the fixing element 54 passes partly through the fixing aperture 56.

Figure 6:
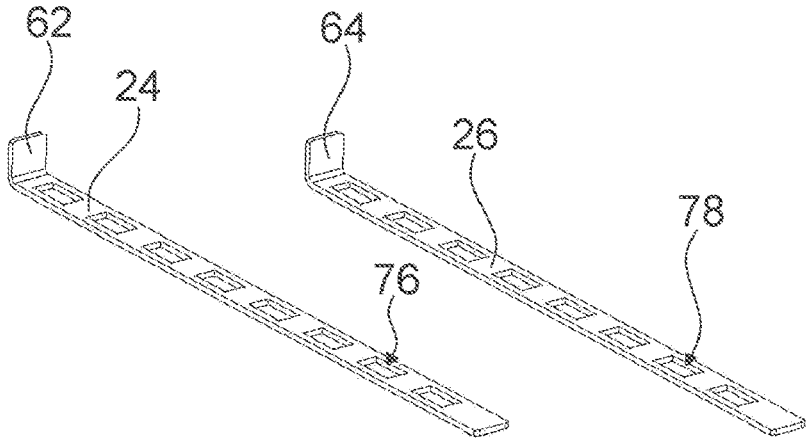
Figure 7:
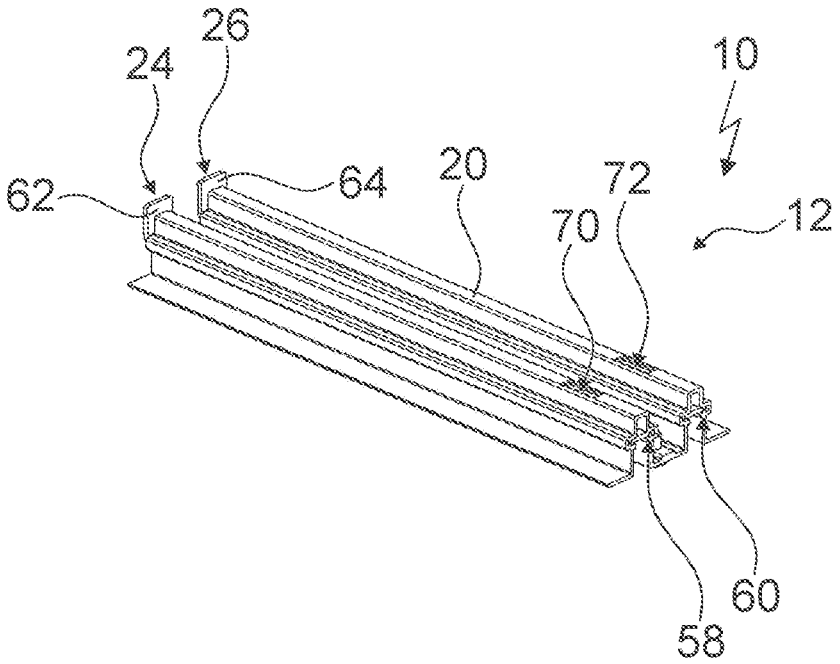

The holding unit 12 comprises a holding element 24 (compare FIGS. 4, 6 and 7). The holding element 24 defines a height level of the first shelf 14 in a mounted position. In a mounted position, the holding element 24 supports the first shelf 14 in a stable position with victuals placed on the first shelf 14.

In the present embodiment, the holding element 24 comprises eight openings 76. The openings 76 are distanced from each other with respect to a longitudinal extension direction of the holding element 24. For the sake of clarity, in the following only one opening 76 is given a reference numeral and is described in detail. The following description may be transferred to the other openings 76 accordingly.

The holding unit 12 comprises a further holding element 26 (compare FIGS. 4, 6 and 7). The further holding element 26 defines a height level of the second shelf 16 in a mounted position. In a mounted position, the further holding element 26 supports the second shelf 16 in a stable position with victuals placed on the second shelf 16.

In the present embodiment, the holding element 26 further comprises eight further openings 78. The further openings 78 are distanced from each other with respect to a longitudinal extension direction of the further holding element 26. For the sake of clarity, in the following only one further opening 78 is given a reference numeral and is described in detail. The following description may be transferred to the other further openings 78 accordingly.

In the present embodiment, the holding element 24 and the further holding element 26 are embodied identically to each other. In an assembled state, the holding element 24 and the further holding element 26 are arranged parallel to each other.

The holding element 24 is in an assembled state inserted in the base body 20. The base body 20 comprises a guiding groove 58 (compare FIGS. 5 and 7). In an assembled state, the holding element 24 is inserted in the guiding groove 58.

In the present embodiment, the holding element 24 is essentially L-shaped. The holding element 24 comprises a stopping part 62. The stopping part 62 stops an insertion movement of the holding element 24 into the base body 20. The stopping part 62 is located on the shorter portion of the approximate L-shape of the holding element 24.

The further holding element 26 is in an assembled state inserted in the base body 20. The base body 20 comprises a further guiding groove 60 (compare FIGS. 5 and 7). In an assembled state, the further holding element 26 is inserted in the further guiding groove 60.

In the present embodiment, the further holding element 26 is essentially L-shaped. The further holding element 26 comprises a further stopping part 64. The further stopping part 64 stops an insertion movement of the further holding element 26 into the base body 20. The further stopping part 64 is located on the shorter portion of the approximate L-shape of the further holding element 26.

In a mounted position, the base body 20 holds the holding element 24 and the further holding element 26 when the first shelf 14 and the second shelf 16 are loaded. In a mounted position, the base body 20 supports the weight of the first shelf 14 and of victuals placed on the first shelf 14. In a mounted position, the base body 20 supports the weight of the second shelf 16 and of victuals placed on the second shelf 16.

Figure 8:
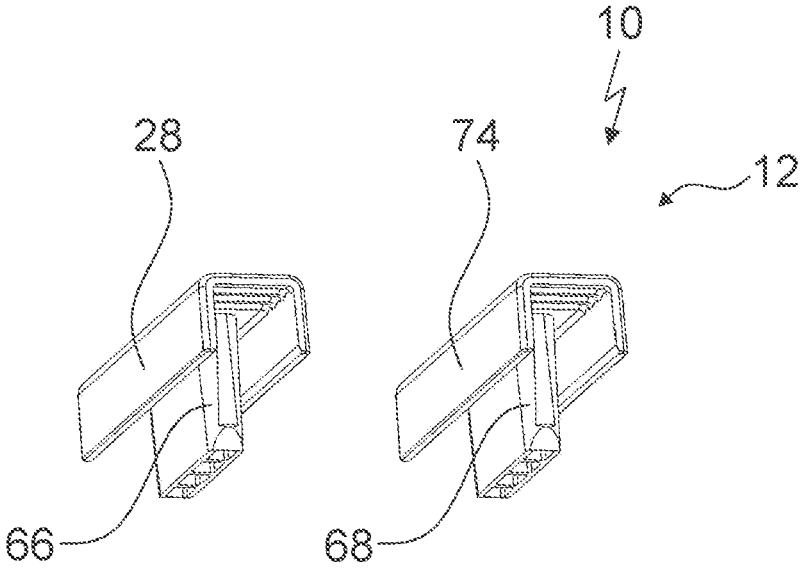
Figure 9:
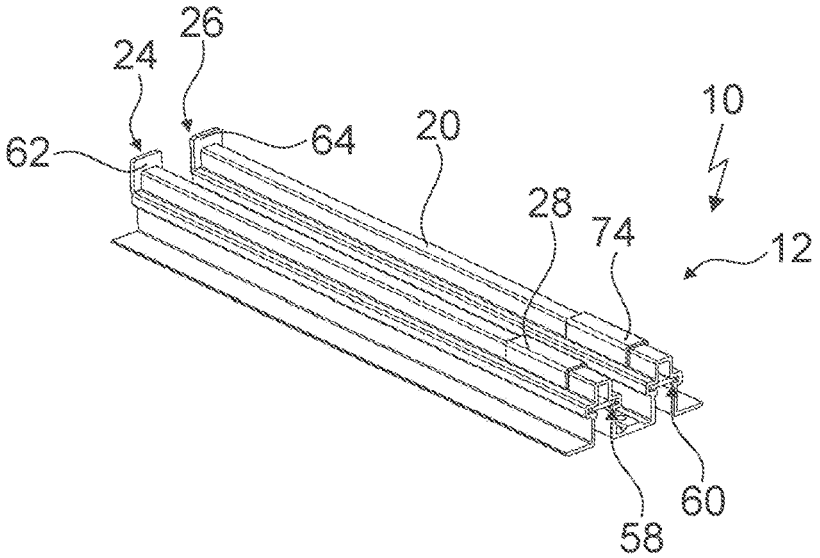

The holding unit 12 comprises an alignment element 28 (compare FIGS. 8 and 9). In an assembled state, the alignment element 28 fixes the holding element 24 in a position relative to the base body 20.

The base body 20 comprises at least one alignment aperture 70 (compare FIGS. 4, 5 and 7). In the present embodiment, the holding unit 12 comprises one alignment aperture 70. The alignment element 28 comprises a projection 66 (compare FIG. 8). In an assembled state, the projection 66 partly projects through the alignment aperture 70. In an assembled state, the projection 66 partly projects through the opening 76 of the holding element 24 (compare also FIGS. 12 to 15).

The holding unit 12 comprises a further alignment element 74 (compare FIGS. 8 and 9). In an assembled state, the further alignment element 74 fixes the further holding element 26 in a position relative to the base body 20.

The base body 20 comprises at least one further alignment aperture 72 (compare FIGS. 4, 5 and 7). In the present embodiment, the base body comprises one further alignment aperture 72. The further alignment element 74 comprises a further projection 68 (compare FIG. 8). In an assembled state, the further projection 68 partly projects through the further alignment aperture 72. In an assembled state, the further projection 68 partly projects through the further opening 78 of the further holding element 26 (compare also FIGS. 12 to 15).

In the present embodiment, the alignment element 28 and the further alignment element 74 are embodied identically to each other.

Figure 10:
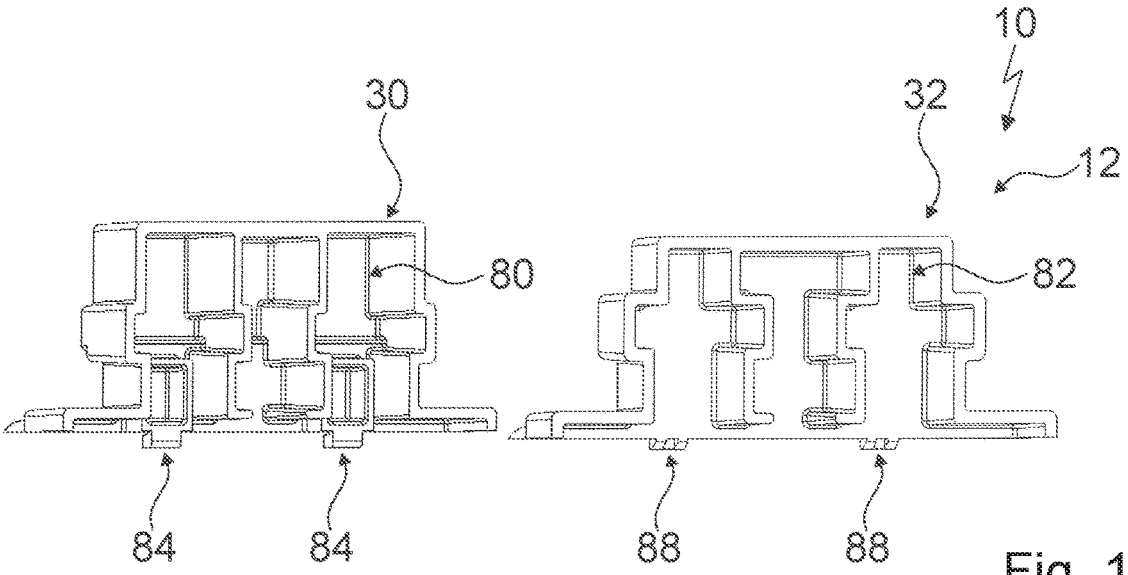
Figure 11:
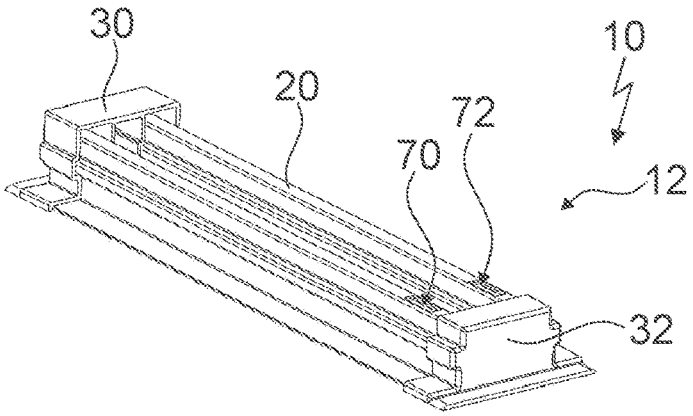
Figure 12:
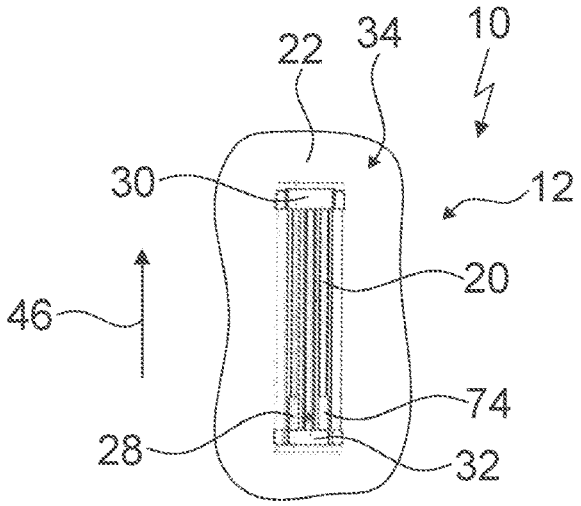

The holding unit 12 comprises a first end cap 30 (compare FIGS. 10 and 11). In an assembled state, the first end cap 30 is mounted to the base body 20. The first end cap 30 comprises at least one first receiving portion 80 for receiving at least a portion of the base body 20. In an assembled state, a portion of the base body 20 is located in the first receiving portion 80 of the first end cap 30. In an assembled state, the first end cap 30 and the base body 20 are connected to each other in a form-fit manner.

The holding unit 12 comprises a second end cap 32 (compare FIGS. 10 and 11). In an assembled state, the second end cap 32 is mounted to the base body 20. The second end cap 32 comprises at least one second receiving portion 82 for receiving at least a portion of the base body 20. In an assembled state, a portion of the base body 20 is located in the second receiving portion 82 of the first end cap 30. The second end cap 32 and the base body 20 are in an assembled state connected to each other in a form-fit manner.

In an assembled state, the holding unit 12 is arranged to a major part behind the inner liner 34 (compare FIGS. 12 to 15). In an assembled state, the holding unit 12 partially passes through the inner liner 34.

The inner liner 34 has two apertures 36. The apertures 36 are arranged parallel to each other. The inner liner 34 comprises a web 86. The web 86 is located between the apertures 36 with respect to the width direction 18. In an assembled state, the fixing element 54 is fixed to the web 86. For the sake of clarity, in the following only one aperture 36 is described in detail. The following description may be transferred to the other aperture 36 accordingly.

In an assembled state, a main extension direction of the aperture 36 is parallel to the vertical direction 46. The holding unit 12 partially passes through the aperture 36 in an assembled state. In an assembled state, the first end cap 30 partially passes through the aperture 36 of the inner liner 34.

Figure 13:
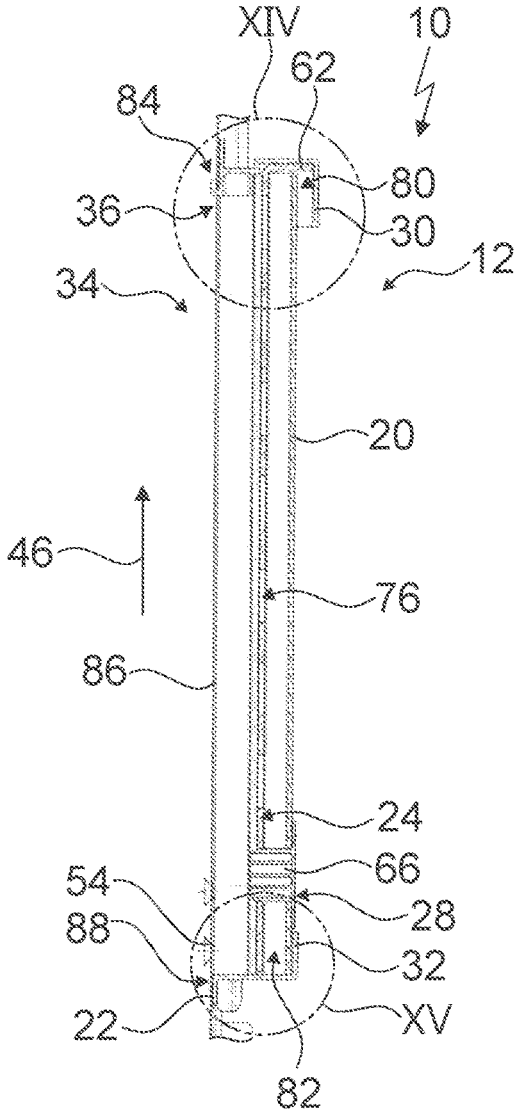
Figure 14:
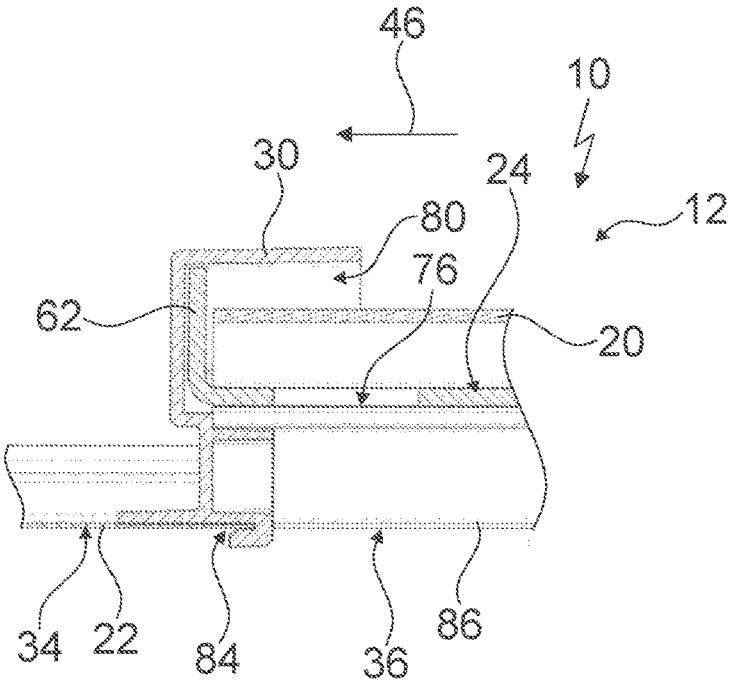
Figure 15:
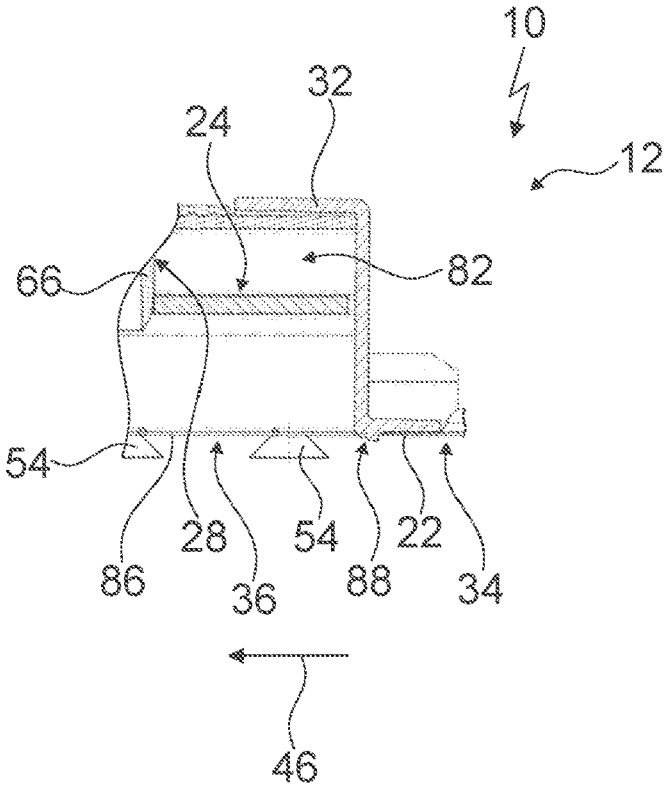

The holding unit 12 comprises two retainers 84 for partly receiving the inner liner 34 (compare FIGS. 10, 13 and 14). For the sake of clarity, in the following only one retainer 84 is described in detail. The following description may be transferred to the other retainer 84 accordingly.

The retainer 84 is arranged at the first end cap 30. In the present embodiment, the retainer 84 and the first end cap 30 are embodied in one piece.

The holding unit 12 comprises two connecting elements 88 for a connection to the inner liner 34 (compare FIGS. 10, 13 and 14). For the sake of clarity, in the following only one connecting element 88 is described in detail. The following description may be transferred to the other connecting element 88 accordingly.

The connecting element 88 is arranged at the second end cap 32. In the present embodiment, the connecting element 88 and the second end cap 32 are embodied in one piece. The connecting element 88 is embodied as a clipping element.

Figure 16:
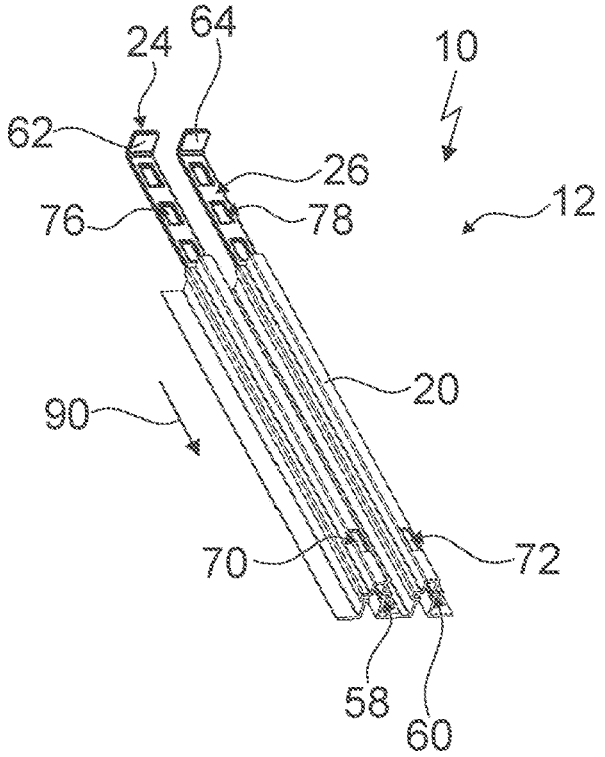
Figure 17:
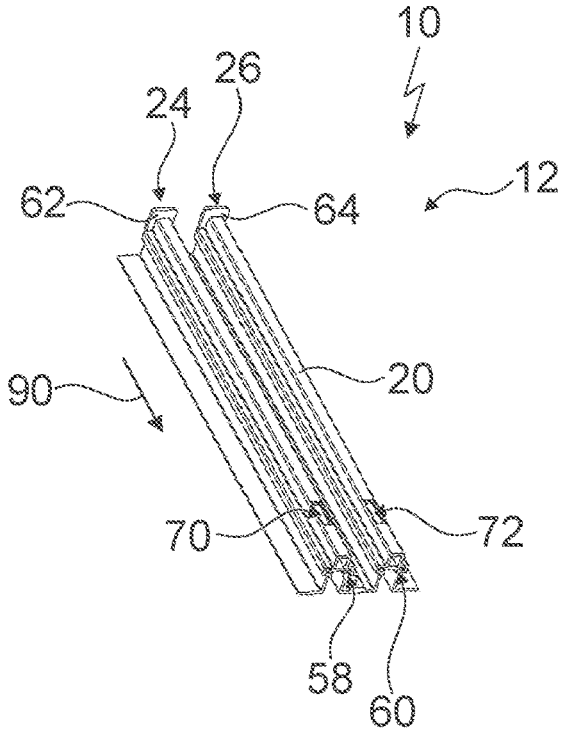

A method for assembling the home appliance device 10 comprises the step of connecting the holding unit 12 to the inner liner wall section 22. In one step the holding element 24 is inserted into the guiding groove 58 of the base body 20 (compare FIGS. 16 and 17). The holding element 24 is inserted into the guiding groove 58 of the base body 20 in an insertion direction 90 until the stopping part 62 of the holding element 24 stops the movement of the holding element 24 in the insertion direction 90.

Figure 18:
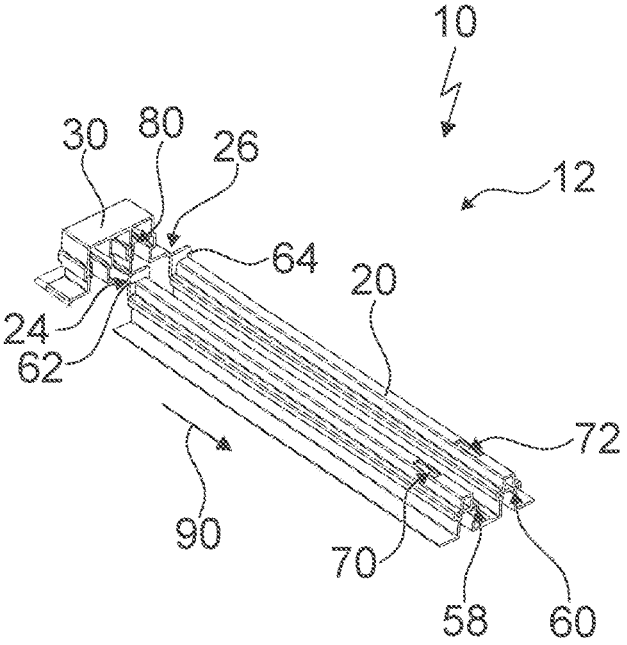
Figure 19:
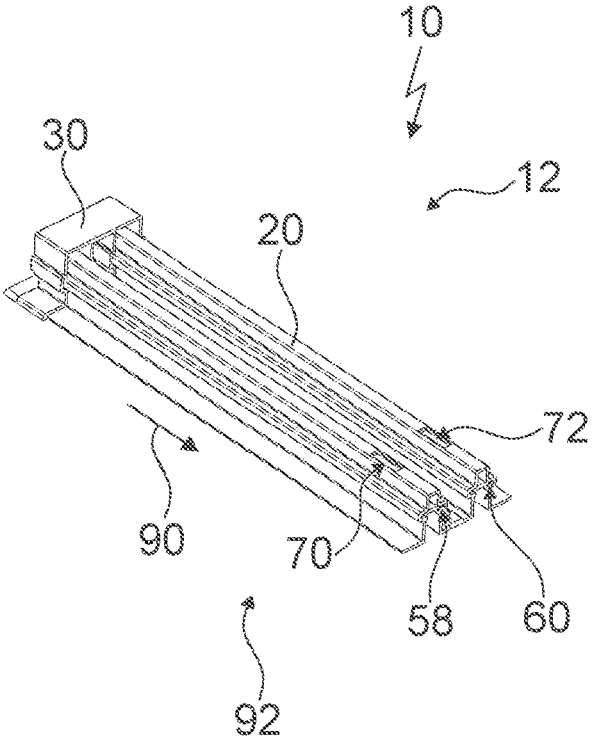

In one step the further holding element 26 is inserted into the further guiding groove 60 of the base body 20 (compare FIGS. 18 and 19). The further holding element 26 is inserted into the further guiding groove 60 of the base body 20 in the insertion direction 90 until the further stopping part 64 of the further holding element 24 stops the movement of the further holding element 26 in the insertion direction 90.

In one step, the first end cap 30 is connected to the base body 20. The first end cap 30 is moved in the insertion direction 90 until the portion of the base body 20 is located in the first receiving portion 80 of the first end cap 30.

Figure 20:
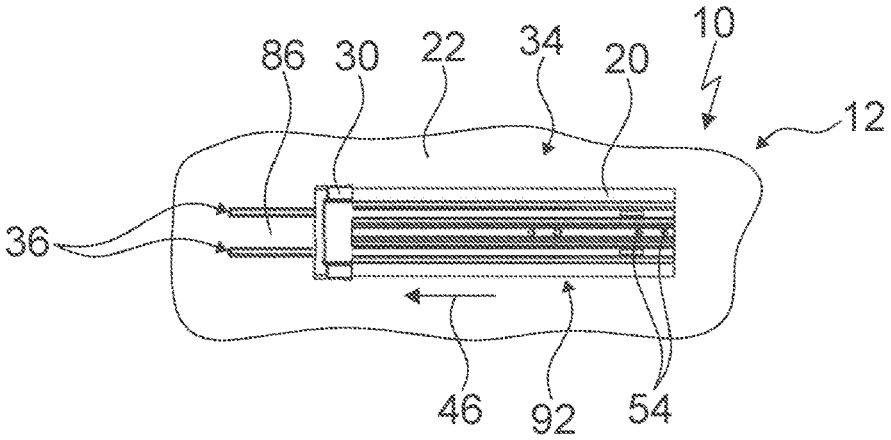
Figure 21:
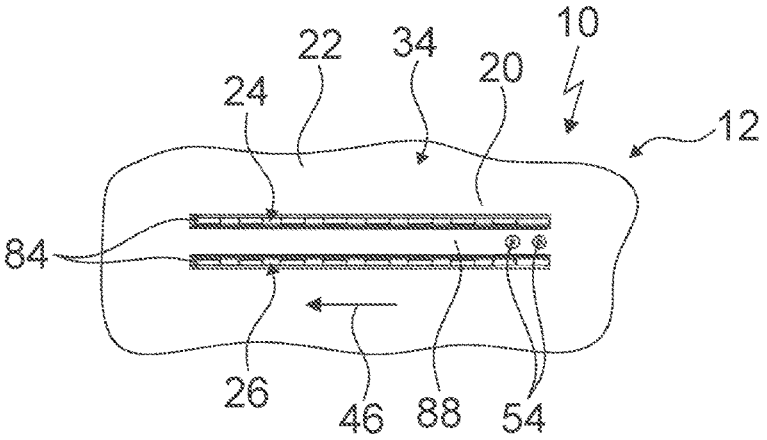

The first end cap 30, the base body 20 and the holding elements 24, 26 constitute a subassembly group 92. In one step, the subassembly group 92 is placed onto the inner liner 34, in particular in such a way that the retainer 84 is located in the aperture 36 (compare FIGS. 20 and 21). In one step, the subassembly group 92 is moved in a direction that is parallel to the vertical direction 46, in particular until the inner liner wall section 22 engages with the retainer 84. In one step, the subassembly group 92 is fixed to the inner liner 34 by means of the fixing element 54.

Figure 22:
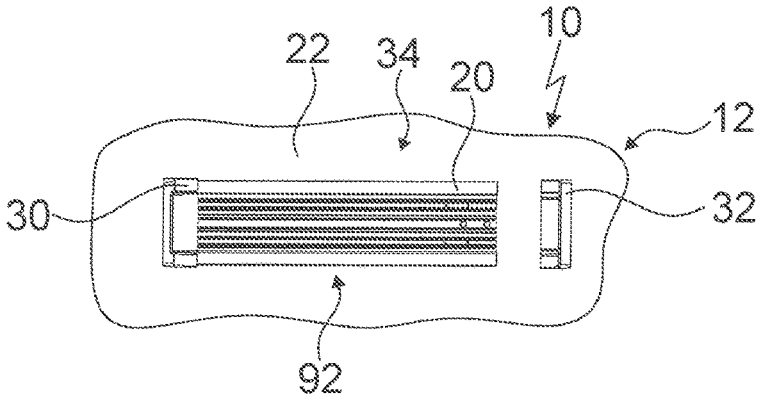
Figure 23:
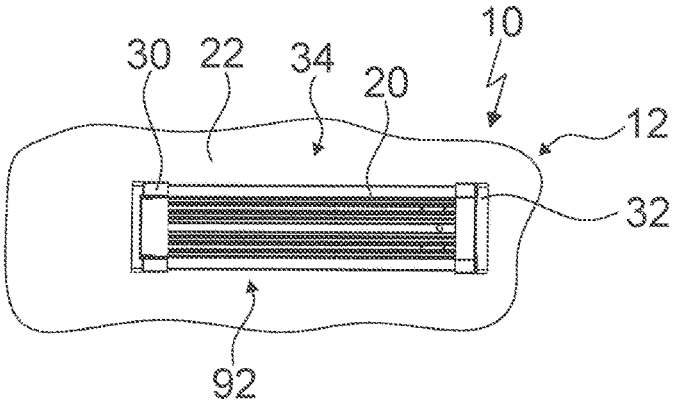

In one step, the second end cap 30 is connected to the subassembly group 92 (compare FIGS. 22 and 23). The second end cap 30 is moved in a direction that is parallel to the vertical direction 46. By moving the second end cap 32 in the direction that is parallel to the vertical direction 46, the portion of the base body 20 engages with the second receiving portion 82 of the second end cap 32. The second end cap 32 is moved in the direction that is parallel to the vertical direction 46 until the connecting element 88 engages with the aperture 36.

Figure 24:
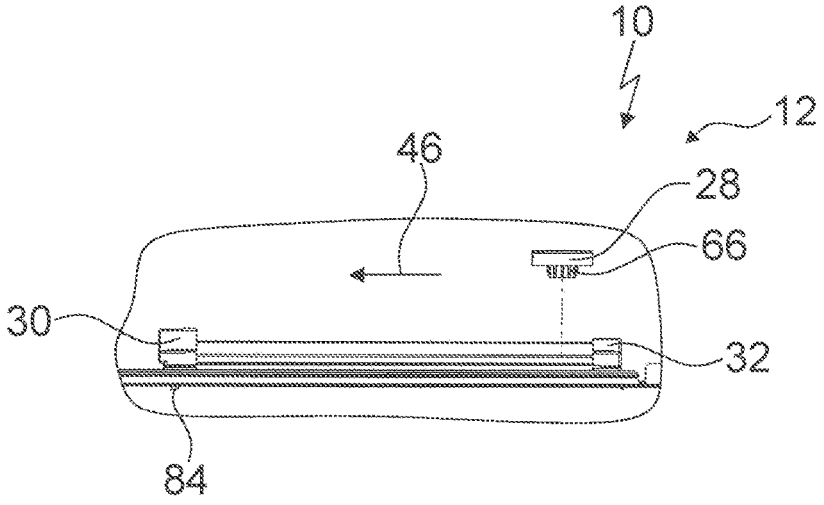

In one step, the alignment element 28 is fixed to the base body 20 in order to keep the holding element 24 in the correct position (compare FIG. 24). In one step, the further alignment element 74 is fixed to the base body 20 in order to keep the further holding element 26 in the correct position.

Figure 25:
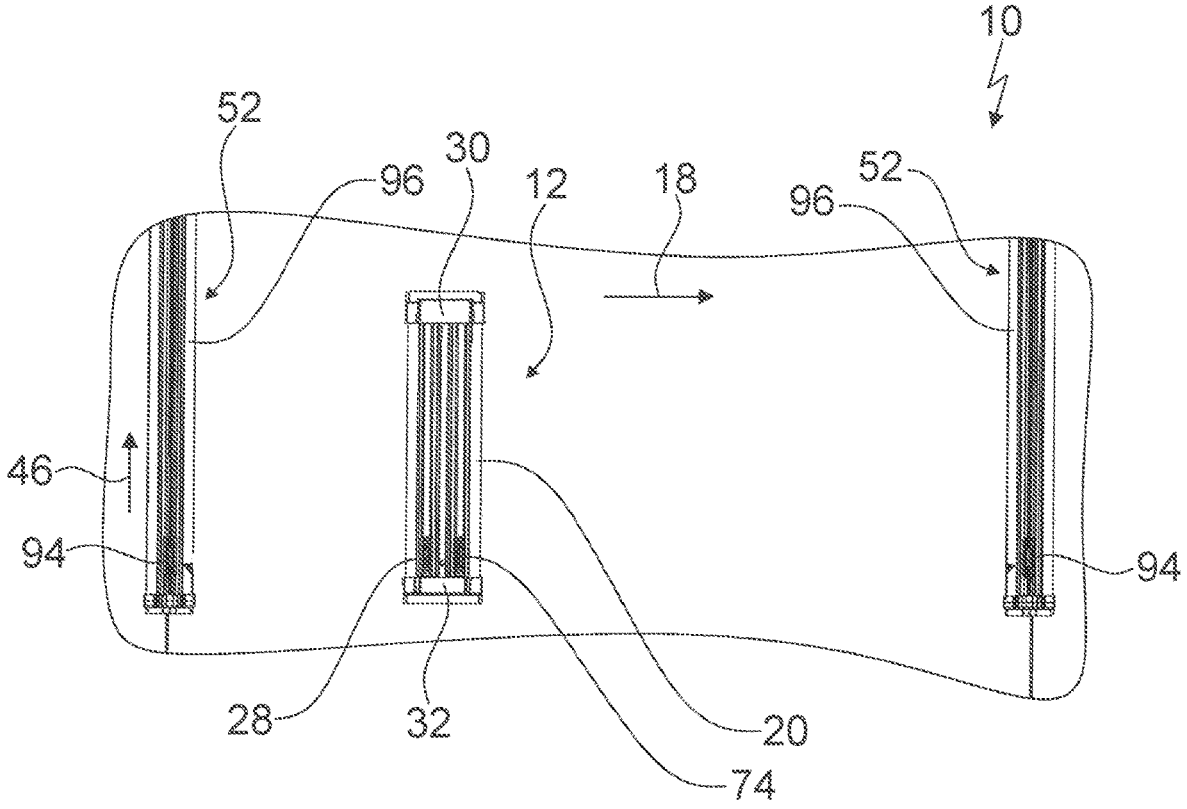

Each rail unit 52 comprises at least one rail alignment element 94 (compare FIGS. 2 and 25). In the present embodiment each rail unit 52 comprises one rail alignment element 94. In an assembled state, the rail alignment element 94 fixes a rail holding element 98 in a position relative to a rail base body 96 of the corresponding rail unit 52.

The following is a summary list of reference numerals and the corresponding structure used in the above description of the invention:

10 Home appliance device
12 Holding unit
14 First shelf
16 Second shelf
18 Width direction
20 Base body
22 Inner liner wall section
24 Holding element
26 Further holding element
28 Alignment element
30 First end cap
32 Second end cap
34 Inner liner
36 Aperture
38 Home appliance
40 Base
42 Appliance body
44 Appliance door
46 Vertical direction
48 Appliance door
50 Third shelf
52 Rail unit
54 Fixing element
56 Fixing aperture
58 Guiding groove
60 Further guiding groove
62 Stopping part
64 Further stopping part
66 Projection
68 Further projection
70 Alignment aperture
72 Further alignment aperture
74 Further alignment element
76 Opening
78 Further opening
80 First receiving portion
82 Second receiving portion
84 Retainer
86 Web
88 Connecting element
90 Insertion direction
92 Subassembly group
94 Rail alignment element
96 Rail base body
98 Rail holding element

The invention claimed is:

1. A home appliance device, comprising:

at least one inner liner having at least one planar wall section;

at least one holding unit disposed mostly behind said at least one planar wall section and configured to at least partly hold at least one first shelf and at least one second shelf, the holding unit being configured to hold the first shelf next to the second shelf with respect to at least one width direction;

said at least one holding unit having a base body connected to said at least one planar wall section, said base body having ends and said base body including guiding grooves and holding elements each configured to be inserted in a respective one of said guiding grooves to define a height level and position of said shelves;

said holding unit including at least one end cap mounted to and covering at least one of said ends of said base body, said at least one end cap partially passing through at least one aperture in said inner liner; and alignment elements being separate from said holding elements for fixing said holding elements in a position relative to said base body.

2. The home appliance device according to claim 1, configured as a chiller home appliance.

3. The home appliance device according to claim 1, said holding unit being configured to hold the first shelf and the second shelf in at least one mounted position at at least substantially the same height level.

4. The home appliance device according to claim 1, said holding elements being arranged parallel to each other.

5. The home appliance device according to claim 1, said holding being arranged parallel to each other.

6. The home appliance device according to claim 1, said holding elements being embodied identically to each other.

7. The home appliance device according to claim 1, wherein said holding unit includes at least one retainer being integral with said at least one end cap and disposed in said at least one aperture for at least partly receiving said inner liner.

8. A home appliance, comprising at least one home appliance device according to claim 1.

9. The home appliance according to claim 8 configured as a chiller home appliance.

10. The home appliance device according to claim 1, wherein said holding elements each have an end with a respective L-shaped stopping part for stopping an insertion movement of each of said holding elements into a respective one of said guiding grooves.

11. The home appliance device according to claim 1, wherein said alignment elements have projections each passing through a respective alignment aperture in said base body and an opening in a respective one of said holding elements.

12. A method for assembling a home appliance device, the method comprising:

providing the home appliance device with at least one inner liner, which has at least one planar inner liner wall section;

providing at least one holding unit, which is configured to at least partly hold at least one first shelf and at least one second shelf, the holding unit being configured to hold the first shelf next to the second shelf with respect to at least one width direction, and thereby connecting the holding unit mostly behind the at least one planar inner liner wall section, and the holding unit having at least one end cap;

connecting a base body of the at least one holding unit to the at least one planar wall section, the base body having ends;

inserting holding elements into respective guiding grooves of the base body to define a height level of the shelves;

covering at least one of the ends of the base body with the at least one end cap of the holding unit and passing the at least one end cap partially through at least one aperture in the inner liner; and using alignment elements being separate from the holding elements for fixing the holding elements in a position relative to the base body.

13. The method according to claim 12, which comprises assembling a home appliance device according to claim 1.

14. The method according to claim 12, which further comprises providing an end of each of the holding elements with a respective L-shaped stopping part for stopping an insertion movement of each of the holding elements into a respective one of the guiding grooves.

15. The method according to claim 12, which further comprises inserting projections of each of the alignment elements through a respective alignment aperture in the base body and an opening in a respective one of the holding elements.

16. The method according to claim 12, which further comprises providing the holding unit with at least one retainer being integral with the at least one end cap, and placing the at least one retainer in the at least one aperture for at least partly receiving the inner liner.

* * * * *